United States Patent [19]

Trombatore

[11] 4,150,664

[45] Apr. 24, 1979

[54] SPATTER SCREEN FOR STOVE

[76] Inventor: Edward T. Trombatore, 4139 Whistler Ave., El Monte, Calif. 91732

[21] Appl. No.: 898,678

[22] Filed: Apr. 21, 1978

Related U.S. Application Data

[63] Continuation of Ser. No. 720,123, Sep. 3, 1976, abandoned.

[51] Int. Cl.[2] ..... F24C 15/12

[52] U.S. Cl. ..... 126/299 C; 292/251.5

[58] Field of Search ..... 126/299 R, 299 C, 299 D, 126/202, 214 D, 389, 332; 220/370, 230, 346; 160/351, 290, DIG. 16; 292/251.5; 98/DIG. 8; 248/304

[56] References Cited

U.S. PATENT DOCUMENTS

| | | | |
|---|---|---|---|
| 1,717,772 | 6/1929 | Greenwald | 126/332 X |
| 1,970,054 | 8/1934 | Hordan | 126/299 C |
| 1,974,643 | 9/1934 | Collins | 126/299 C |
| 2,500,881 | 3/1950 | Stader | 248/304 X |
| 2,565,905 | 8/1951 | Belav | 126/299 C |
| 2,568,276 | 9/1951 | Eggleston | 126/299 C X |
| 2,607,961 | 8/1952 | Allen | 292/251.5 X |
| 2,667,704 | 2/1954 | Dunn | 248/304 X |
| 2,840,408 | 6/1958 | Scott et al. | 292/251.5 |
| 3,452,895 | 7/1969 | Kalkowski | 220/370 |
| 4,037,581 | 7/1977 | Trifiletti | 126/214 D X |

FOREIGN PATENT DOCUMENTS

| | | | |
|---|---|---|---|
| 1170304 | 1/1959 | France | 126/299 C |
| 363143 | 12/1931 | United Kingdom | 126/299 C |
| 419553 | 11/1934 | United Kingdom | 126/299 C |

*Primary Examiner*—William F. O'Dea
*Assistant Examiner*—Harold Joyce
*Attorney, Agent, or Firm*—Christie, Parker & Hale

[57] ABSTRACT

A removable frame supports a spatter-intercepting screen positioned adjacent burners of a cooking stove. Grease particles and the like are trapped by the screen to protect walls and appliances near the stove. The screen is substantially transparent and easily cleaned, and in one version can be moved to a retracted position in the frame when the stove is not in use.

2 Claims, 10 Drawing Figures

Fig. 6
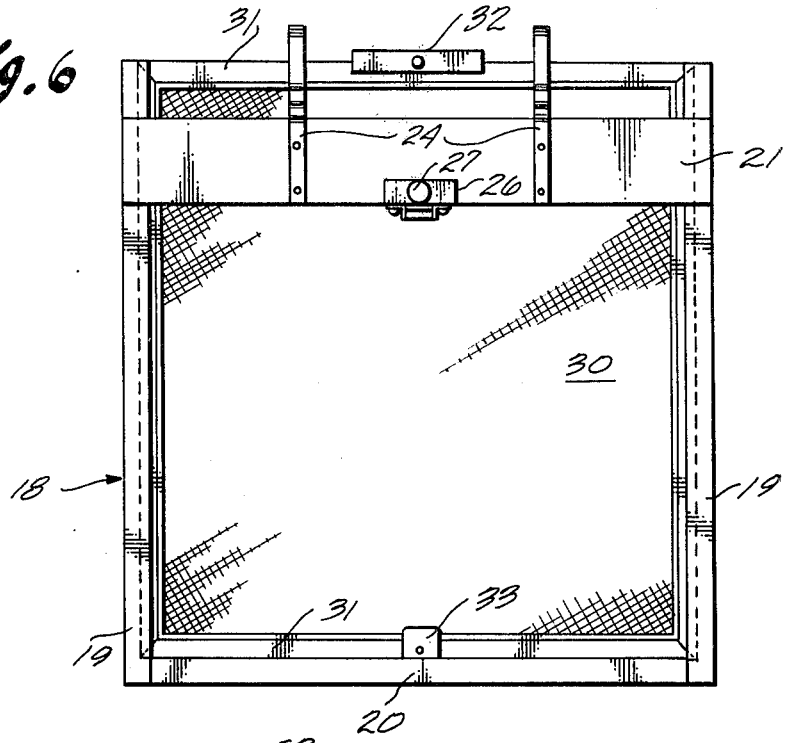
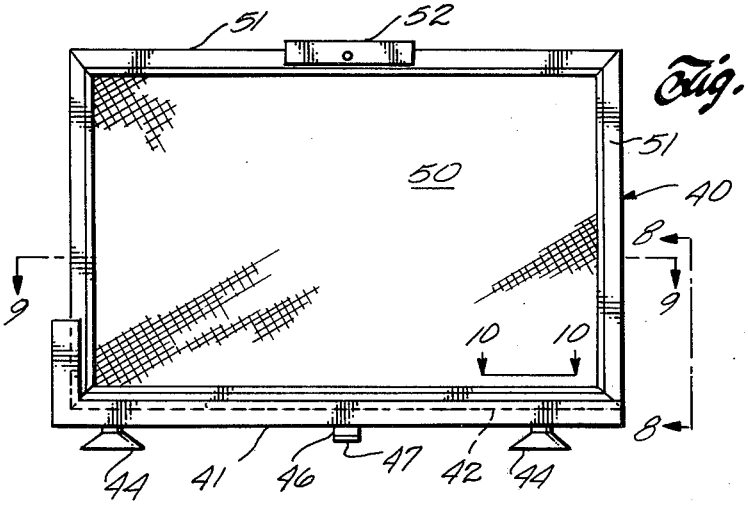
Fig. 7
Fig. 8
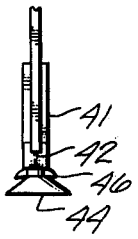
Fig. 9
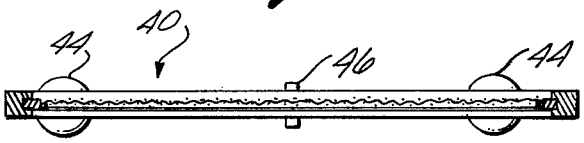
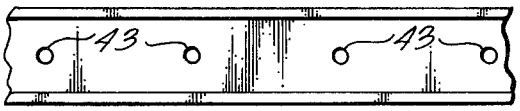
Fig. 10

SPATTER SCREEN FOR STOVE

CROSS-REFERENCE TO RELATED APPLICATION

This is a continuation of my U.S. patent application Ser. No. 720,123 filed Sept. 3, 1976, abandoned.

BACKGROUND OF THE INVENTION

Many foods tend to spatter grease and other particles when being cooked on a stove-top burner. The spattered particles can travel considerable distances (especially when frying or cooking at relatively high temperature), and wall or appliance surfaces adjacent the stove soon become soiled and require frequent cleaning if permanent staining and discoloration of the surfaces are to be avoided.

The use of solid metal sheets or panels to intercept spattered particles is known, but these devices have not been fully satisfactory for several reasons. A significant drawback of solid panels is that spattered material tends to accumulate and run down the panel, spreading the greasy material and quickly leading to an enlarged and messy dustcatching surface. Grease may also run off the bottom of the solid panel to soil the stove or floor.

Another problem with solid panels is that they are awkward and difficult to clean thoroughly, and in time acquire a stained appearance which cannot be corrected in spite of vigorous scrubbing. This kind of staining is often seen on refrigerator sidewalls adjacent stoves and unprotected by a spatter shield. Solid panels are of course also opaque, and in some installations may undesirably limit the view of surfaces behind the panel.

The spatter shield of this invention uses a conventional screen of the type used for window screening. I have found that a relatively fine metal screen is highly effective in trapping and holding spattered particles, but is very easy to clean by immersion in soapy water. The screen does not tend to acquire the unattractive stained appearance of a solid panel, and is lighter and easier to position than a solid metal sheet. Visibility of objects behind the screen is preserved because the screen is nearly transparent.

My invention also contemplates the use of several alternative mounting systems for supporting the screen on a stove. One system uses a frame with a set of brackets configured to fit over the stove edge and under a top panel which is fitted around the burners on most conventional stoves. The screen makes a sliding fit in the frame to be retractable out of the way alongside the stove when spattering foods are not being cooked. A fitting such as a magnetic latch is used to hold the screen in an elevated position during cooking.

Another mounting system is especially useful when no space is available alongside the stove to permit retraction of the screen. This configuration uses a frame which is attached to the top surface of the stove by suction cups or a similar mounting means. The screen seats in the frame during cooking, but is completely removable for cleaning or storage when not needed to protect surfaces adjacent the stove.

SUMMARY OF THE INVENTION

Briefly stated, this invention relates to a spatter screen assembly for a stove. The assembly includes a frame, and a mounting means secured to and adapted to attach the frame to a stove. A mesh screen, which is preferably a metal screen of about 16/18 mesh, is adapted for mounting on the frame to be positioned alongside the stove. The screen intercepts material spattered from food being cooked on the stove, thereby preventing soiling and staining of adjacent surfaces.

In one form, the frame is configured to mount the screen to be movable between a retracted position in which the screen is substantially contained by the frame, and an extended position where the screen projects above the frame when the frame is vertically positioned at the side of the stove. In this form, the mounting means includes a pair of support brackets secured to an upper part of the frame, the brackets having a generally inverted-U shape configured to hook over the stove. The mounting means may further include a spacer member for supporting the frame in a vertical position against the stove, and preferably includes a latching means such as a magnetic latch for releasably holding the screen in the extended position.

In an alternative form, the frame mounting means comprises a pair of suction cups mounted along a lower edge of the frame to be secured to the upper surface of the stove. In this configuration, a stabilizer bar is also mounted at the lower end of the frame to resist tipping of the frame and screen with respect to the stove.

DESCRIPTION OF THE DRAWINGS

FIG. 6 is an elevation of an inner side of the assembly which faces the stove;

FIG. 7 is an elevation of an alternative form of the assembly;

FIG. 8 is a partial end view on line 8—8 of FIG. 7;

FIG. 9 is a top sectional view on line 9—9 of FIG. 8; and

FIG. 10 is an enlarged top view on line 10—10 of FIG. 7 showing a portion of the assembly with the screen removed.

DESCRIPTION OF THE PREFERRED EMBODIMENTS

Figure 1:
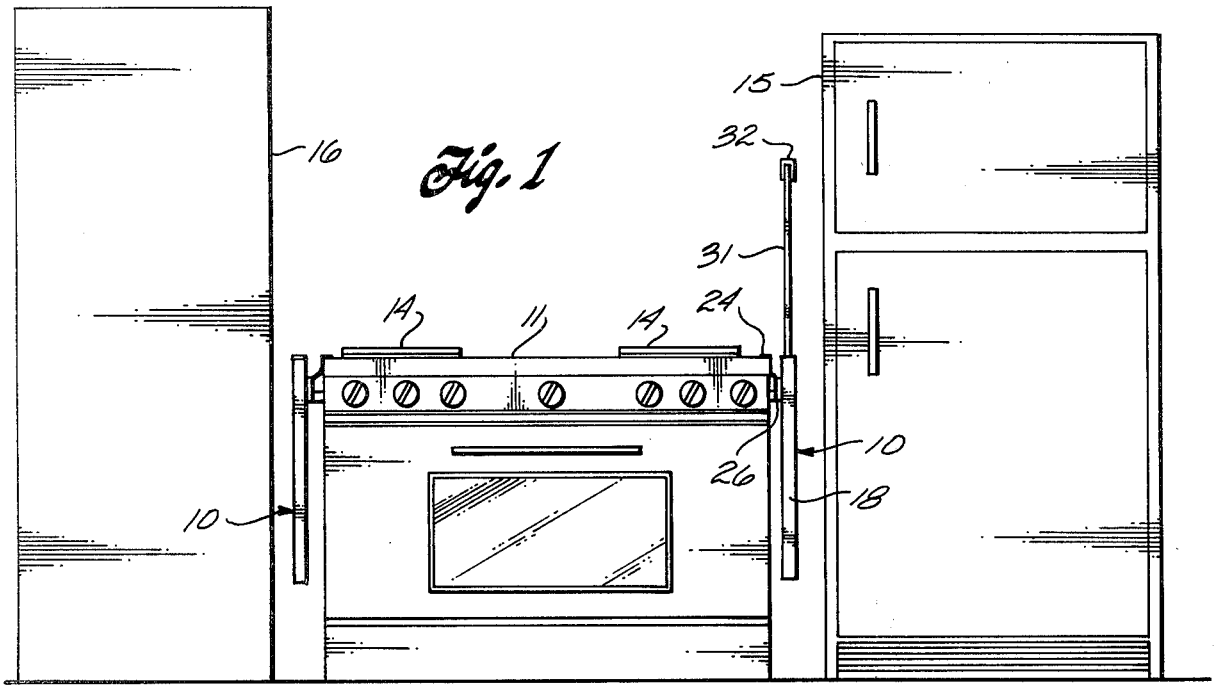
FIG. 1 is an elevation of a pair of spatter screen assemblies according to the invention, the assemblies being mounted at opposite ends of a stove.

A pair of spatter screen assemblies 10 according to the invention are shown mounted at opposite ends of a stove 11 in FIG. 1. The assembly at the right side of the stove is shown in an operating position with a screen positioned to intercept any food or grease particles which might be spattered from food being cooked on a top burner 14 at the right side of the stove. The particles are thus intercepted before they can strike and soil the side of a refrigerator 15 positioned at the right side of the stove. A cabinet 16 at the left side of the stove is similarly protected by the other assembly which is shown with the screen in a retracted position.

Assembly 10 is shown in detail in FIGS. 2-6, and includes a frame 18 which may be made of metal or plastic, but is preferably formed from wood which is attractive and economical. The frame comprises a pair of upright channel-shaped side members 19 joined at their lower ends by a base member 20. The upper ends of the side members are joined and supported by an upper cross member 21.

A pair of spaced-apart bracket members 24 are secured by the screws or the like to cross member 21. The bracket members are preferably made of sheet metal, and have a generally inverted-U shape to fit over the edge of a stove when the usual top panel which surrounds the burners is removed. Each bracket member has a horizontal terminal end 25 which is disposed beneath the top panel when it is replaced on the stove.

A bumper or spacer 26 having a cork or felt pad 27 fastened thereto is secured to a lower central portion of the upper cross member, and the spacer pad rests against the stove when the frame is installed as shown in FIG. 1 to support the frame in a vertical position with respect to the stove. A magnetic latch 28, of a conventional type used on cabinet doors, is secured to the underside of spacer 26.

A mesh screen 30 is supported in a conventional screen frame 31 of the type used in window screens. A handle 32 is secured at the upper end of the screen frame. A small ferrous-metal tab 33 is centrally secured at the bottom of the screen frame as best seen in FIG. 6.

Screen 30 is preferably a mesh of galvanized wires of the type used in conventional window screening. A relatively fine screen is preferred to trap small food particles, and a 16/18 mesh is quite satisfactory. In a typical configuration, screen frame 31 is about 19 inches square, and this size is quite adequate to intercept food particles from pots or pans on several burners of a stove.

Figure 2:
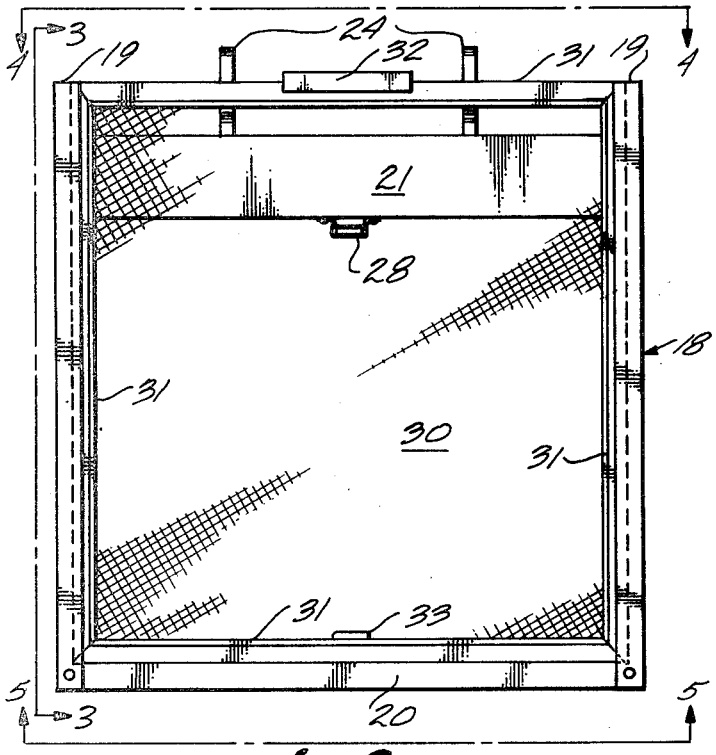
FIG. 2 is an elevation of an outer side of a spatter screen assembly.
Figure 3:
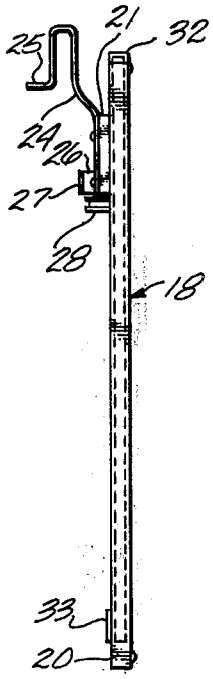
FIG. 3 is an end view on line 3—3 of FIG. 2.
Figure 4:
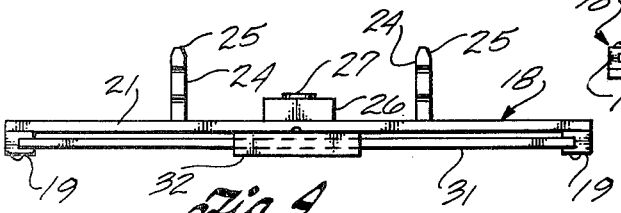
FIG. 4 is a top view on line 4—4 of FIG. 2.
Figure 5:
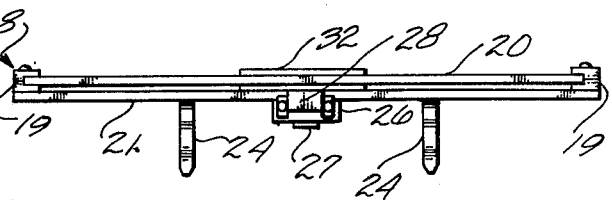
FIG. 5 is a bottom view on line 5—5 of FIG. 2.

As best seen in FIGS. 4–5, screen frame 31 is configured to make a slip fit within channel-shaped side members 19 of the frame, and the screen frame is shown in a fully seated or retracted position in FIG. 2. When the screen is to be used to protect adjacent surfaces from spattered particles from the stove, the screen and screen frame are raised vertically within frame 18 until ferrous tab 33 comes into alignment and engagement with magnetic latch 28. The screen is then in the position shown at the right side of the stove in FIG. 1, and is ready for use.

The screen and screen frame can be fully withdrawn from frame 18 simply by forcing tab 33 past magnetic latch 28. The screen and screen frame can then be immersed in sudsy water to remove any intercepted food particles and grease, thereby permitting quick and simple cleaning of the screen to maintain it in an attractive position. Although the screen mesh is relatively fine, it is substantially transparent, and does not block the view of objects behind the screen.

In some stove installations as found in, for example, modern apartment buildings, there is no free space on the sides of the stove to permit mounting of assembly 10 as shown in FIG. 1. In this situation, an alternative version of a spatter screen assembly 40 as shown in FIGS. 7–10 is useful. Assembly 40 includes a generally L-shaped frame 41 which defines a continuous channel 42. A plurality of threaded openings 43 (FIG. 10) are formed through the base of the frame, and a pair of suction cups 44 are threaded into a selected pair of the openings. A plurality of threaded openings are provided so the spacing of the suction cups can be varied to insure a proper fit on any particular stove.

Preferably, a stabilizer bar 46 is secured to the underside of frame 41 to extend at right angles to the longitudinal axis of the frame base. The depth of the stabilizer bar is dimensioned to place the bar in contact with a top surface of the stove when suction cups 44 are secured to the same top surface. Preferably, the underside of the stabilizer bar includes a felt pad 47 to avoid marring the stove surface. Bar 46 increases the rigidity of the frame when mounted on the stove, and offsets any tendency of the frame to tip as might happen if the suction cups alone were used to support the frame.

A metal mesh screen 50, of the same type as described above, is supported in a screen frame 51 having a handle 52 secured thereto. In a typical form, screen frame 51 is generally rectangular, and has dimensions of about 12 inches by 19 inches. I have found that this size is adequate to intercept spattered particles in the top-mounted configuration of my invention.

Frame 51 is configured to make a snug fit in channel 42 of the frame as shown in FIG. 7. The screen and screen frame can be simply lifted out of the frame when cleaning is necessary, or if the spatter-intercepting function of the screen is not needed.

I have found that a relatively fine metal-mesh screen is far superior to a solid panel for intercepting spattered food and grease particles from food being cooked on a stove. The spattered material does not tend to run downwardly as it does on a solid panel, and the screen is substantially transparent, light in weight, and easy to clean and maintain in a bright and attractive condition. The screen and screen frame are readily available at shops making conventional window screens, and can be economically replaced if any damage to the screen should occur.

I claim:

1. A spatter screen assembly for a stove having a generally horizontal upper surface with a heater for cooking food, comprising:

a frame;

mounting means secured to the frame and adapted to mount the frame in an upright position alongside the stove upper surface, the mounting means including a support bracket extending laterally from the frame and having a downwardly extending portion configured to hook over and engage the stove to support the upper end of the frame adjacent the stove upper surface, the mounting means further including a bumper secured to and extending laterally from the frame below the support bracket, the bumper being positioned to contact a side surface of the stove to space the frame horizontally from the side surface and to maintain the frame in a stable vertical position;

a mesh screen slidably mounted on the frame to be movable between retracted and extended positions, the screen when in the retracted position being disposed within the frame and having an upper end which is generally flush with the stove upper surface, and when in the extended position having the upper end higher than the stove upper surface while remaining horizontally spaced apart from the heater so the screen intercepts material spattered from food being cooked on the heater without preventing access to the food; and a latch means operative between the screen and frame for holding the screen in the extended position at a predetermined height, the latch means being of a type which can be bypassed without adjustment by exerting an additional lifting force on the screen to enable the screen to be fully withdrawn from the frame for cleaning.

2. The assembly defined in claim 1 wherein the latch means comprises a magnet secured to the frame, and a magnetically attracted tab secured adjacent a lower end of the screen.

* * * * *